US005423159A

United States Patent [19]

Bankuty et al.

[11] Patent Number: 5,423,159

[45] Date of Patent: Jun. 13, 1995

[54] PIVOTING ROLLER ASSEMBLY FOR TIGHTENING CONTAINER CAPS

[75] Inventors: Geza E. Bankuty; Nicholas J. Perazzo, both of Bradenton, Fla.

[73] Assignee: New England Machinary, Inc., Bradenton, Fla.

[21] Appl. No.: 95,157

[22] Filed: Jul. 20, 1993

[51] Int. Cl.[6] ..... B65B 7/28; B67B 1/06

[52] U.S. Cl. ..... 53/317; 53/331.5; 53/253

[58] Field of Search ..... 53/314, 317, 331.5, 53/331, 490

[56] References Cited

U.S. PATENT DOCUMENTS

| | | | |
|---|---|---|---|
| 1,172,447 | 2/1916 | Forté | 53/331.5 |
| 3,849,973 | 11/1974 | Zetterberg | 53/317 |
| 4,279,114 | 7/1981 | Bode | 53/314 |

OTHER PUBLICATIONS

Brochure: "Model NEILC Multiple Spindle In-Line Capper"—Manufactured by New England Machinery.

*Primary Examiner*—Lowell A. Larson
*Assistant Examiner*—Rodney A. Butler
*Attorney, Agent, or Firm*—Pettis & McDonald

[57] ABSTRACT

The present invention relates to a method and apparatus for capping containers, primarily used with capping machines, that increases the engagement time that a driven roller maintains with a cylindrical side of the container cap so that the roller subtends a predetermined arc about the cylindrical axis of the container. The apparatus comprises a mechanism for resiliently urging the rotatably driven roller into the path of the container and then into engagement with the cap as the container advances on a predetermined path.

6 Claims, 6 Drawing Sheets

PIVOTING ROLLER ASSEMBLY FOR TIGHTENING CONTAINER CAPS

BACKGROUND OF THE INVENTION

1. Field of the Invention

The present invention is directed to a method and an apparatus for rotating caps on containers. The method and apparatus are primarily for use in container capping machines.

2. Description of the Prior Art

Bottle capping machines using the current art have been in existence for over 40 years. The current method for threadably capping bottles, utilizing driven rollers, may be seen in the applicant's In Line Capping Machine Model No. NEIL-C 46-16. The current roller technology advances a container along a predetermined path while gripping the container to prevent rotation. Two driven rollers are placed in a predetermined fixed position on opposing sides of the predetermined path so that each roller simultaneously engages the container cap as the container passes between the driven rollers. The rollers, being in a fixed position, engage the container cap tangentially to the predetermined path of the container. Thus, engagement of the cap by the rollers is for so short a period of time that the amount of rotation imparted to the cap of the container is severely limited.

As the rotation of the cap by these rollers is limited, a series of such pairs of rollers must be used to ensure sufficient total rotation to tighten the cap to the container. This is particularly true when the operation being supported is a capping operation, that is, from the initial engagement of the cap threads with the container threads to the final tightening, which may require several rotations of the cap. The number of pairs of rollers needed will depend upon a number of factors, including the amount of rotation of the cap required and the speed at which the containers are advanced. In a retorquing operation, where the cap is being retightened, the required rotation is small; however, a plurality of pairs of rollers is still needed to ensure proper tightening.

As required by customer specification, many bottle caps must be tightened to a predetermined torque. Due to the rapid movement of the containers and the short duration of time that the fixed rollers are engaged with the caps, it is difficult for a pneumatic friction clutch to obtain accurate torque measurements to ensure that the caps are threaded on the container tightly enough to meet predetermined torque requirements. Extra rollers may be required to ensure that sufficient torque has been applied. There is a need, therefore, for a method and an apparatus that implements the method that permits the rollers to maintain contact with the cap for a longer time period, reducing the number of rollers needed and improving the capability for torque measurement. Such a method will reduce the time for capping each container, increasing the productivity of the machine.

SUMMARY OF THE INVENTION

The present invention is related to a method and an apparatus for rotating caps on containers that is primarily for use in container capping machines. The method includes the steps of: advancing a container along a predetermined path, the container having a generally cylindrical cap positioned thereon; gripping the container to prevent rotation; resiliently urging a rotatably driven roller into contact with the side of the cap; maintaining contact between the roller and the cap while the container is advanced along a portion of the predetermined path so that the roller engages the cap while subtending an arc about the cylindrical axis of the container; and disengaging the roller from the cap.

The apparatus for rotating a cap on a container comprises a support frame to which is attached a means for advancing a container along a predetermined path. The container, as it moves along the path, has a cylindrical cap positioned thereon and the container has a cylindrical axis. At least one roller is carried by the support frame and is rotatably driven for rotation about an axis that is generally parallel to the cylindrical axis of the container. Connected to the driven roller are means for urging that roller into contact with the side portion of the cylindrical cap that is positioned on the container. The roller is maintained in contact with the container as it advances along a portion of its predetermined path so that the roller engages the side portion of the cap while subtending a predetermined arc of at least 10 degrees about the cylindrical axis of the container.

BRIEF DESCRIPTION OF THE DRAWINGS

A preferred embodiment of the method and apparatus of this invention will be disclosed in detail below in connection with the drawings in which.

DESCRIPTION OF A PREFERRED EMBODIMENT

An embodiment of the apparatus and method of this invention is illustrated in FIGS. 1–5 in relationship to other, related apparatus that may conveniently be a cap retorquing machine that retightens caps that have become loosened during the processing of the product. As will be discussed below, the improvements to the apparatus that are illustrated with respect to the retorquer capping machine can be applied to other types of capping equipment that utilize driven rollers for turning container caps. The basic equipment illustrated, to which the improvement has been added, is well known in the art and can be found in capping machines currently on the market, for example, the applicant's In Line Capping Machine Model No. NEIL-C 46-16.

Figure 1:
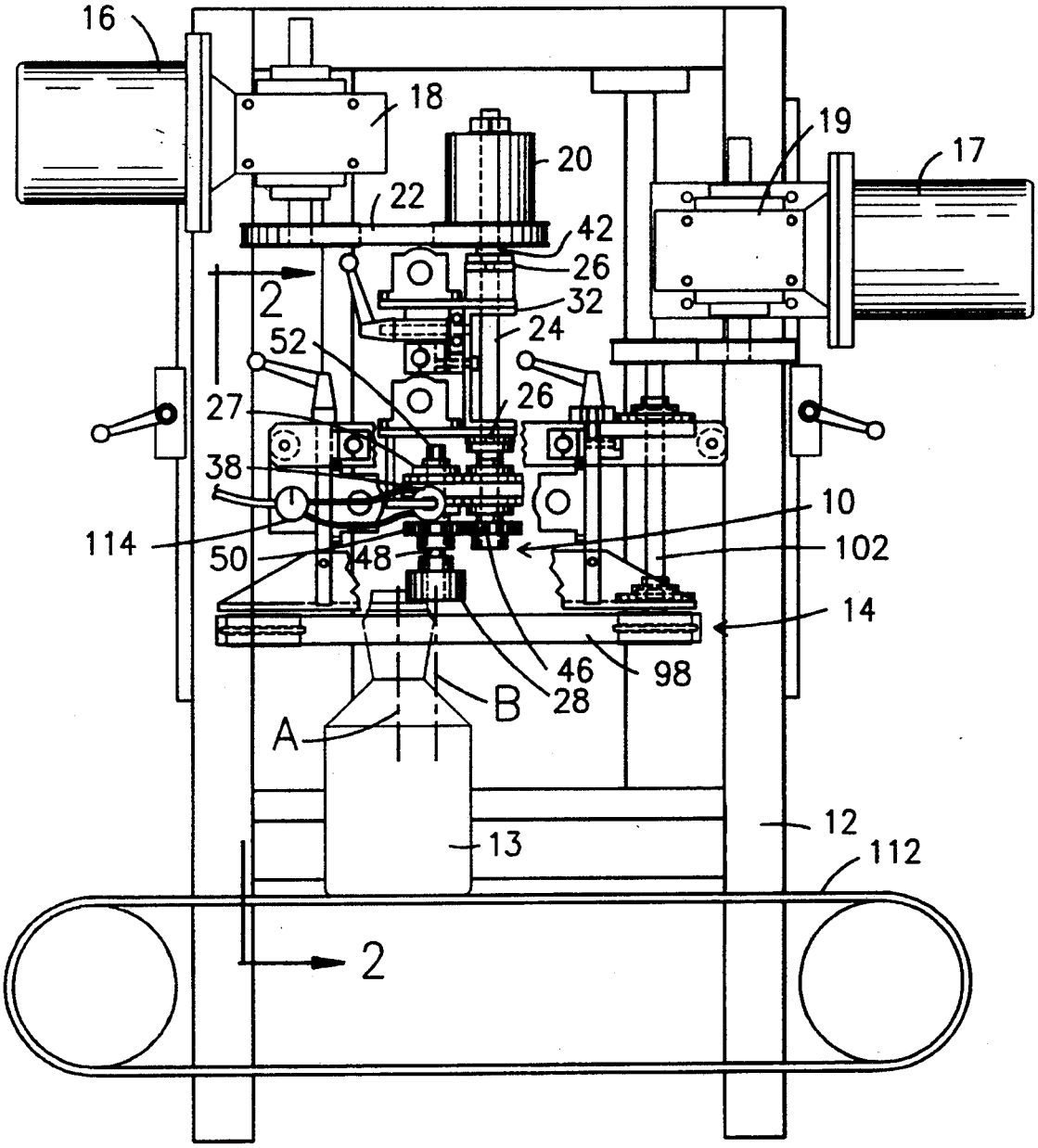
FIG. 1 is a front side view of one embodiment of the apparatus of this invention illustrated as a portion of a retorquer capping machine.
Figure 2:
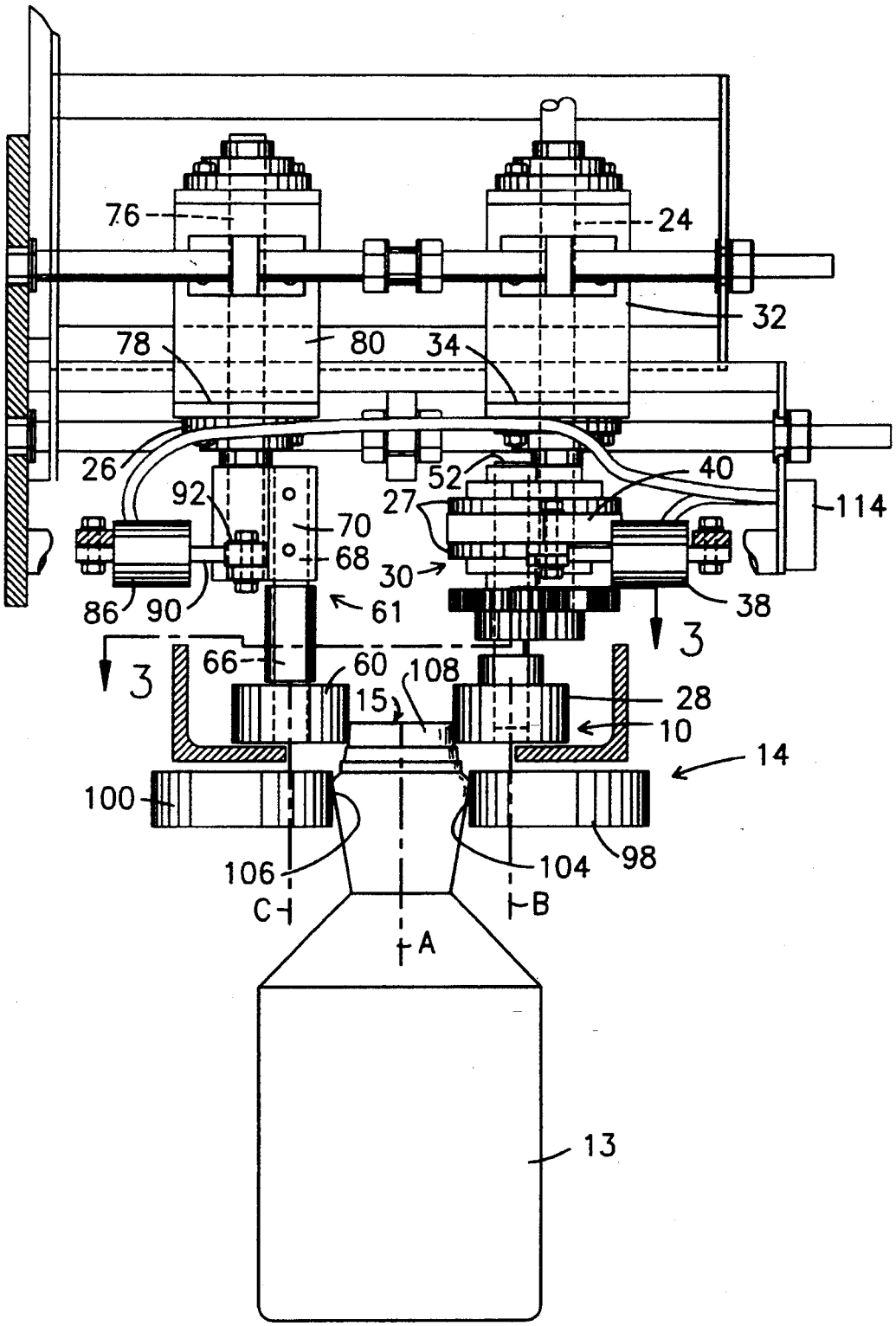
FIG. 2 is a fragmentary end sectional view of the apparatus of FIG. 1 taken along line 2—2 and shown at a larger scale.

The cap retorquer illustrated in FIGS. 1 and 2, is generally indicated as 10. An in-line capping machine is very similar to the retorquer as illustrated, the major difference being that the in-line capping machine comprises a plurality of pairs of fixed driven rollers aligned in series along the predetermined path of the container. The retorquer, as disclosed in FIG. 1, comprises a support frame 12 upon which are mounted means for advancing a container 13 along a predetermined path, conveniently a container gripper 14. The container 13 has a generally cylindrical cap 15 positioned thereon, the cap having a cylindrical axis A and axially extending side portion 108. A first drive motor 16 and a second drive motor 17 and their respective gear reducers 18 and 19 are mounted on the frame 12. The gear reducers 18 and 19 provide the appropriate rotational speed to the respective connected drive shafts 24 and 102 of the retorquer 10. A pneumatic friction clutch 20 is driven by a belt 22 connected to gear reducer 18. A drive shaft 24 is mounted to the frame 12 by a plurality of flange bearings 26, which can be seen more clearly in FIG. 6. One end of drive shaft 24 is operatively attached to clutch 20, and the other end is connected to roller 28, driving it for rotation about axis B of the roller 28. Axis B is generally parallel to the cylindrical axis A of the cap 15.

Figure 6:
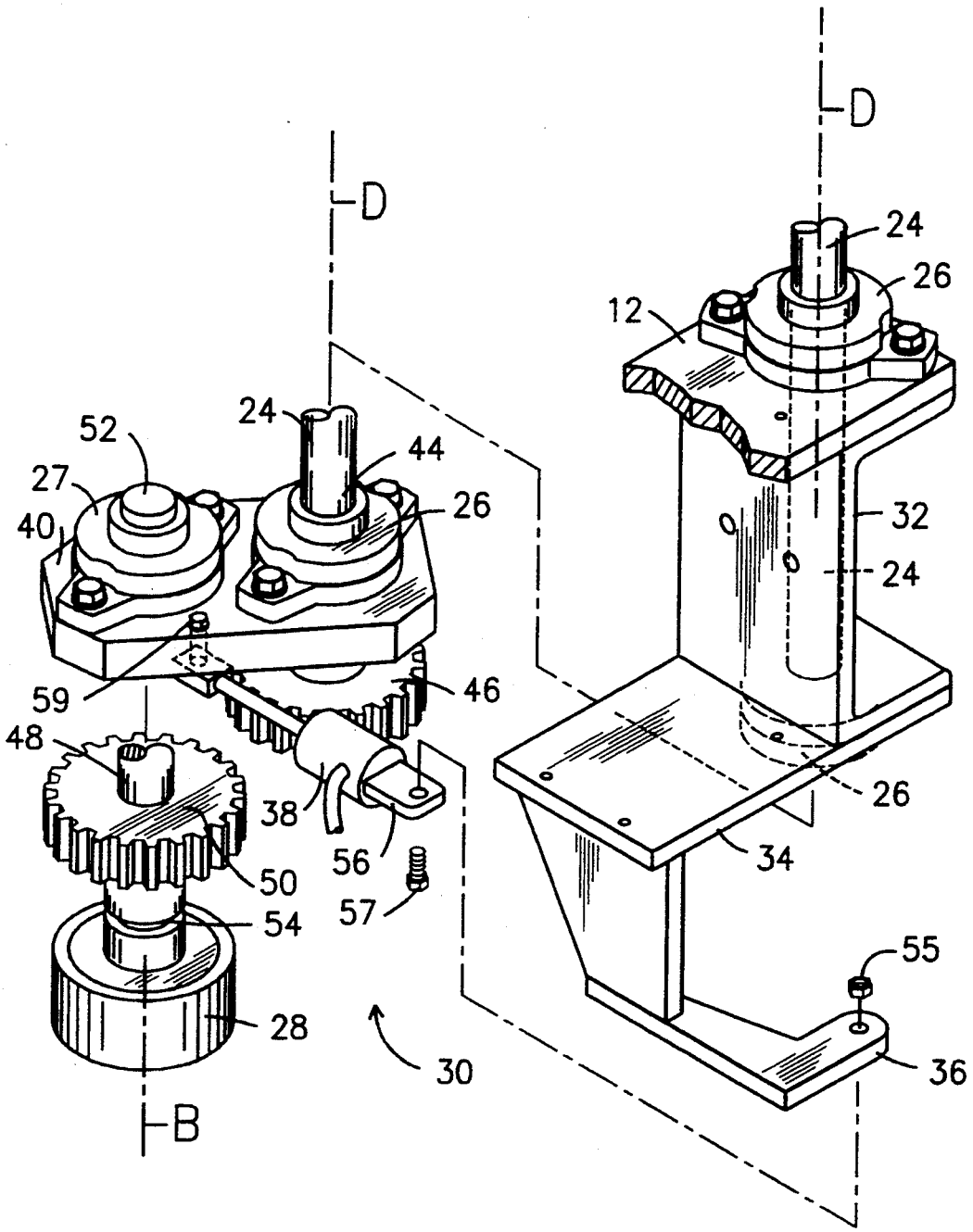
FIG. 6 is a detailed exploded view of the driven roller assembly of this apparatus.

The improvement of this invention can be most clearly seen in FIG. 6, which discloses a driven roller assembly, shown generally as 30. The driven roller assembly 30 is mounted to a portion of the support frame 12 including a channel 32. The roller assembly 30 is comprised of an air spring mounting bracket 34 that is mounted to the channel 32. The mounting bracket 34 has a hole (not shown) at one end through which the drive shaft 24 extends, and on the other end has an extension 36 for mounting the biasing means, conveniently air spring 38. An arm 40 has two apertures therethrough (not shown) each aperture being proximal to a respective longitudinal end of the arm 40. The drive shaft 24 is received through one of the apertures so that the arm 40 is pivotally mounted thereon by a pair of flange bearings 26, mounted one on the top and one on the bottom of the arm 40 and generally aligned with that aperture. The drive shaft 24 has a first end 42 that is connected to the clutch 20 and a second end 44 which has a drive gear 46 attached thereto.

A take-off shaft 48 is received through the second aperture located on the opposite end of the arm 40 from the aperture receiving the drive shaft 24. The take-off shaft 48 is rotatably supported by two flange bearings 27, mounted one on the top and one on the bottom of arm 40 and generally aligned with that second aperture. The first end 52 of the take-off shaft 48 is attached to the upper bearing 27 by conventional means. A take-off gear 50 is mounted on the take-off shaft 48 so that it is aligned with and engages drive gear 46, which rotates the take-off shaft 48 in the opposite direction from the drive shaft 24. Driven roller 28 is mounted on the second end 54 of the take-off shaft 48. The fixed end 56 of air spring 38 is attached by conventional means, in this embodiment by a nut 55 and bolt 57, to the bracket extension 36. The piston rod 58 of air spring 38 is attached to the arm 40 proximal to the take-off shaft 48 by conventional means, conveniently a nut and bolt 59.

Figure 7:
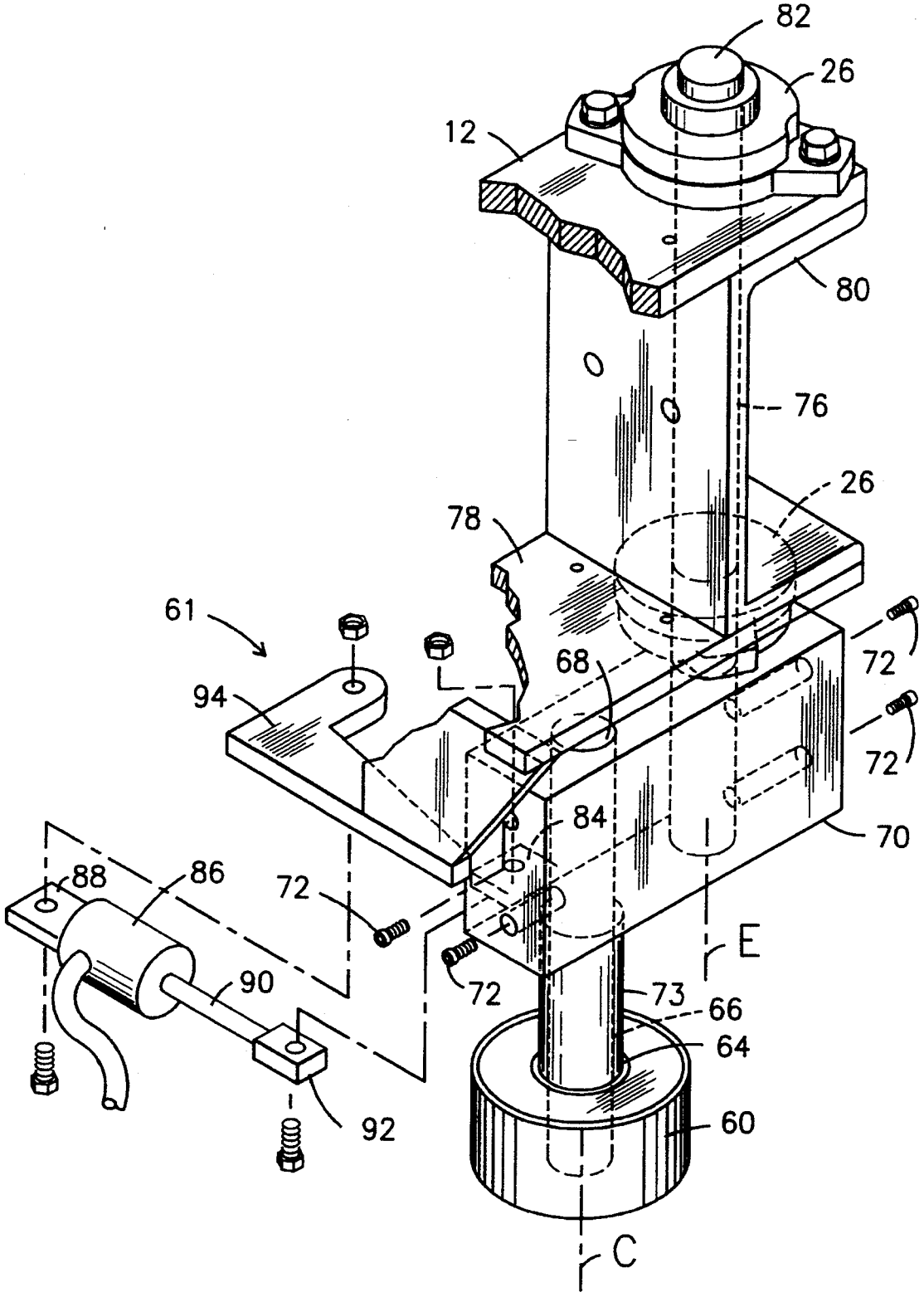
FIG. 7 is a detailed exploded view of the second opposed roller assembly of this apparatus.

As seen in FIGS. 2 and 7, an idler roller 60 having an axis of rotation C generally parallel to the cylindrical axis A of the cap 15 of container 13 is resiliently mounted to the support frame 12 on the side of the container path opposite the side on which is mounted the rotatably driven roller 28. The idler roller 60 is rotatably mounted by well-known bearing means to the first end 64 of a fixed shaft 66. The idler roller assembly 61 can be seen more clearly in FIG. 7, where the second end 68 of the fixed shaft 66 is attached to one end of a second arm 70 by two set screws 72. A spacer tube 73 is mounted around the fixed shaft 66, extending between the second arm 70 and the idler roller 60. The first end 74 of an idler support shaft 76 is attached to the other end of the second arm 70 by two set screws 72. The idler support shaft 76 extends upwardly through a second air spring mounting bracket 78 and a second support channel 80. The second support channel 80 and the second air spring mounting bracket 78 are attached by conventional means, not shown, to the support frame 12. The second end 82 of idler support shaft 76 is pivotably mounted to the second support channel 80 by flange bearings 26. The second end 82 of the idler shaft 76 is attached to the adjacent flange bearing 26 by conventional means, preventing the idler shaft 76 from falling through the adjacent flange bearing 26. The second arm 70 has a tab 84 attached proximal to the fixed idler shaft 66. Resilient biasing means which may suitably be a second air spring 86, has a first end 88 and a piston shaft 90. The first end 92 of the piston shaft 90 is attached by conventional means, to the tab 84. The second air spring mounting bracket 78 has a bracket extension 94 that extends downwardly and away from the predetermined path. The first end 88 of the second air spring 86 is attached to the bracket extension 94 by conventional means.

The container gripper 14, as seen in FIGS. 1 and 2, is conventional and suitably comprises a first belt 98 and a second belt 100, as seen in FIG. 2, which belts may be formed of a suitable synthetic resin, such as polyurethane, or others. As viewed from the top, the first belt 98 is driven about a pair of pulleys (not shown) in a clockwise fashion and the second belt 100 is driven around a pair of pulleys (not shown) in a counterclockwise direction. The second drive motor 17 provides the rotational force necessary to drive the container gripper 14 via a pulley drive shaft 102. The belts 98 and 100 lie in the same plane with the interior portions 104 and 106 running parallel to one another and parallel to the predetermined path. As shown in FIG. 2, a container 13 is gripped between the first belt 98 and the second belt 100 and is moved along the predetermined path at a predetermined rate, as determined by the velocity of the belts 98 and 100. Container grippers of this type are well known in the art and are similar to that used in the applicant's Model No. NEIL-C 46-16.

In the preferred embodiment disclosed most parts are made from carbon steel, however any well-known material suitable for the purpose may be used. The surface of the rollers 38 and 60 that contact the cap 15 are constructed of polyurethane and the belts 98 and 100 are constructed of an elastomer, although any suitable materials may be used.

Figure 4:
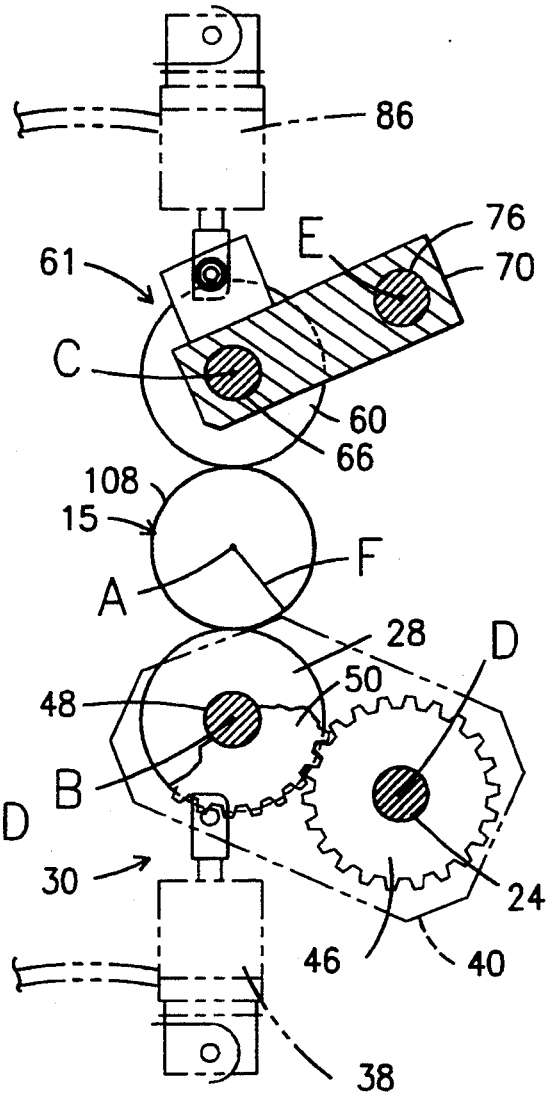
FIG. 4 is a plan view similar to FIG. 3 and illustrating the movement of the bottle cap between the rollers.

Now that the apparatus has been described, the method of operation of the retorquer 10 incorporating the present invention and used with a typical container 13 will be described. The container gripper 14 is adjusted so that it firmly grips the container 13, preventing the container 13 from rotating and advancing the container 13 along the predetermined path. The container gripper 14 is also raised or lowered as necessary so that the extending cylindrical side portion 108 of the cap 15 lies in the same generally horizontal plane as the driven roller 28 and the idler roller 60. With the cap 15 centered between the driven roller 28 and the idler roller 60, as shown in FIG. 4, the rollers 28 and 60 are horizontally adjusted until they come into firm contact with the cap 15.

Figure 3:
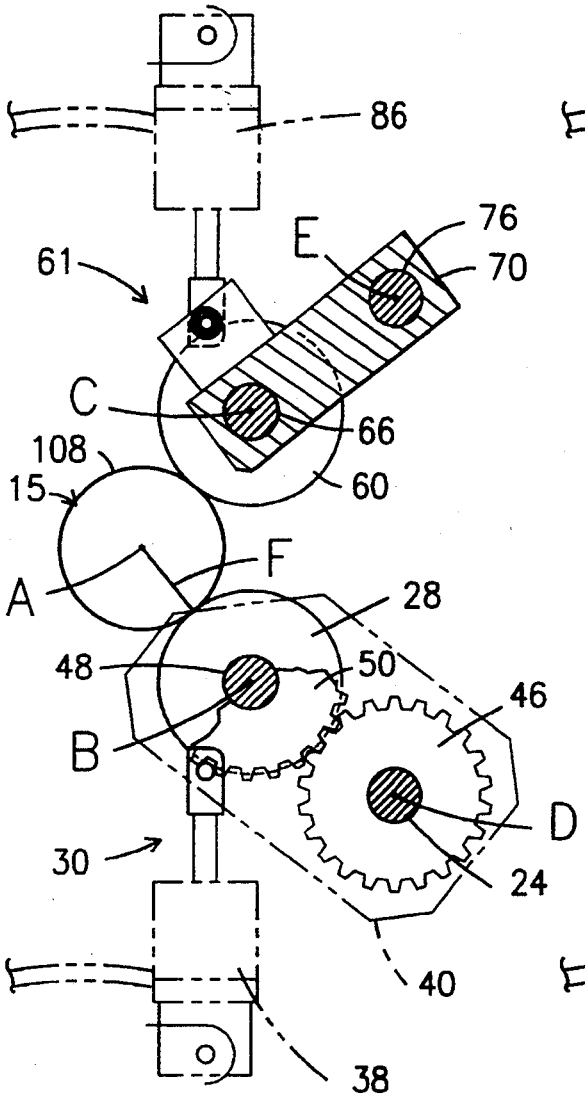
FIG. 3 is a fragmentary plan view of the opposed roller pair assembly of the apparatus of FIG. 1.

With the apparatus 10 in proper adjustment for a particular container size and shape, it is ready for operation. A standard conveyor belt, represented by the belt 112 seen in FIG. 1, is well known in the art and may be used to deliver the containers 13 to the container gripper 14 of the apparatus 10. Other conveyor systems that are well known in the art may also be used. The container gripper 14 advances the container 13 along the predetermined path so that the sides 108 of the cap 15 engage roller 28 and idler roller 60, as shown in FIG. 3. As shown in FIG. 3, the rollers 28 and 60 project into the predetermined path of the cap 15. As seen in FIG. 6, the driven roller 28 pivots about the cylindrical axis D of the shaft 24, and in FIG. 7 it can be seen that the idler roller 60 pivots about the axis E of the pivotable idler shaft 76. The biasing means, conveniently air spring 38 and air spring 86, urge the respective rollers 28 and 60 toward the predetermined path of the container 13. Air springs are well known in the art, and air springs similar to those manufactured by the Bimba Manufacturing Company may be used satisfactorily. Both air springs 38 and 86 are connected to a conventional air regulator 114, as seen in FIG. 1, which is suitable for the control of the air springs. The regulator is connected to a pressurized air source (not shown) and to each of the air springs 38 and 86. The appropriate air to be provided by the regulator 114 to develop the appropriate resistance in the air springs is determined by the necessary friction to be generated between the rollers and the sides 108 of the cap 15 and is readily determined and set for a given application. Adjustment of the air pressure in the air spring by adjustment of air regulator 114 permits the selection of the appropriate pressure to be applied for the particular cap 15 being used. The length and the sizes of the hoses leading to each air spring affects the resiliency of the gripping action of the rollers. The greater the air column stored within the hoses, the greater the amount of compression of that air column is permitted. Other biasing means may be used successfully, such as compression springs; however, it has been found that air springs provide a more consistent and easily adjustable resistance and are thus preferable.

Figure 5:
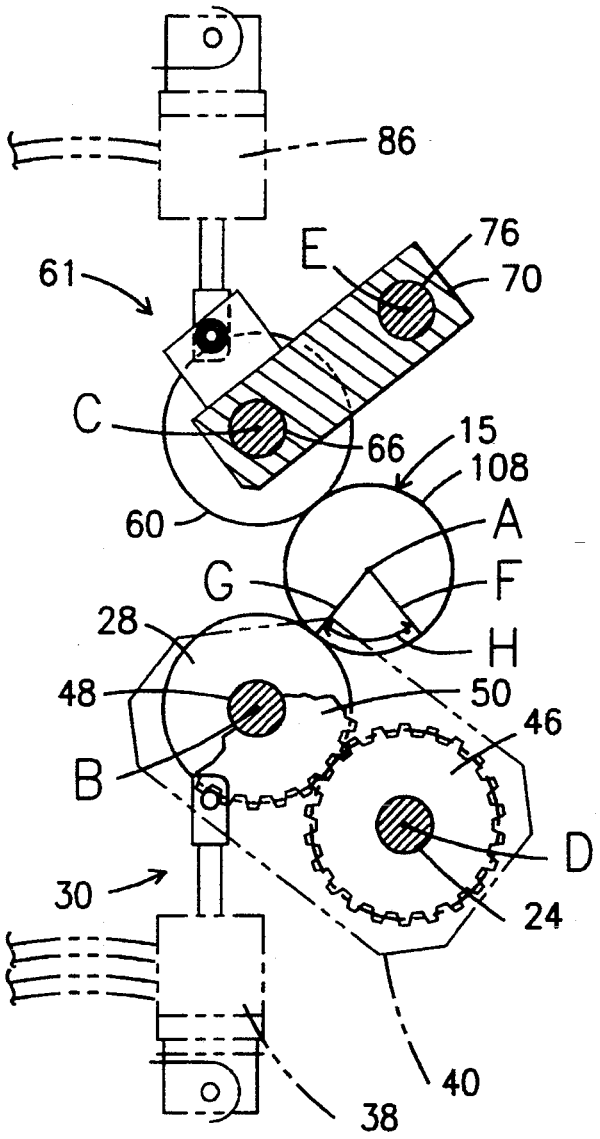
FIG. 5 is a plan view similar to FIGS. 3 and 4 and illustrating the disengagement of the container cap from the rollers.

As the container moves between the rollers 28 and 60 the rotatably driven roller 28 provides a turning force to the cap 15 so that it is threadably rotated onto the container 13. The longer that roller 28 is kept in contact with the side portion 108 of the cap 15, the greater the angular rotation and the greater rotational forces that can be applied to the cap 15 by a given drive roller 28. As can be seen by FIGS. 3, 4 and 5, the roller 28 subtends an arc H from point F to G about the axis A of the cap 15. The arc H in this embodiment is substantially greater than 10 degrees, reaching between approximately 75 and 80 degrees. In other embodiments, the arc G may be greater than 90 degrees, depending on the arm length and roller size.

Idler roller 60 is mounted on the idler shaft 66 with ball bearings (not shown), such "frictionless" rollers being well known in the art. The idler roller 60 is generally opposed to the driven roller 28 providing stability to the cap 15 as it is rotated so that the threads (not shown) of the cap will easily engage with the threads (not shown) on the container without excessive frictional forces.

In a preferred embodiment, when caps are attached to containers, they are rotated until they meet a predetermined resistance that is a measure of how tightly the cap has been placed on the container. Clutch 20, a pneumatic friction clutch well known in the art, slips upon reaching a predetermined resistance to the rotation of the driven roller 28. The longer that the driven roller 28 maintains contact with the sides 108 of the cap 110, the more accurately the clutch 20 may determine whether the predetermined resistance has been met. A retorquer is used to retighten caps that have become loosened during the processing of the product, therefore the amount of rotation required to retighten the cap is normally small. However, when the arc G that is subtended upon the cap 15 is large, it will permit the clutch 20 to properly gauge the amount of resistance, and thus properly tighten the bottle top to a preset standard of tightness. As mentioned previously, the drive roller assembly 30 and the idler roller assembly 61 may be used in generally the same fashion on in-line capping machines, replacing the generally fixed rollers with those that pivot subtending an arc about the axis A of the container 13. The use of a drive roller assembly 30 and an idler roller assembly 61 provides for greater angular rotation by each such roller assembly and thus is more efficient than fixed rollers and will reduce the number of rollers required. Fixed rollers must be aligned to close tolerances with the container caps to ensure adequate contact between the fixed roller and the caps is maintained. When fixed rollers move slightly out of alignment the caps will not be tightened. When using the pivoting drive roller assembly 30 and idler roller assembly 61 close tolerances do not have to be maintained with the cap 15 as the rollers 28 and 60 pivot into contact with the cap 15.

While the foregoing description is directed to particularly preferred embodiments of the present invention, it is to be understood that these embodiments are representative only of the principles of the invention and are not to be considered limitative thereof. Because numerous variations and modifications of both the apparatus and the method, all within the scope of the present invention, will become apparent to those skilled in the art, the scope of the invention is to be limited solely by the claims appended hereto.

What is claimed is:

1. Apparatus for rotating caps on containers, comprising a support frame;

means carried by said support frame for advancing a container along a predetermined path, said container having a generally cylindrical cap positioned thereon, said cap having a cylindrical axis and an axially extending cylindrical side portion;

at least one arm having first and second ends, said second end being mounted to said support frame for pivotal movement of said first end toward and away from said container path;

a rotatably driven roller driven for rotation about an axis generally parallel to said cylindrical axis, said rotatably driven roller being carried by said first end of said arm; and biasing means for resiliently urging said arm first end and said roller toward said container path such that said rotatably driven roller contacts said cap cylindrical side portion on said container, maintaining said contact while said container is advanced along a portion of said predetermined path such that said roller contacts said cap cylindrical side portion while subtending an arc about said cylindrical axis of at least 10 degrees.

2. The apparatus of claim 1 wherein said roller engages said cap cylindrical side portion while subtending an arc about said cylindrical axis of at least 20 degrees.

3. The apparatus of claim 1 wherein said roller engages said cap cylindrical side portion while subtending an arc about said cylindrical axis of at least 75 degrees.

4. The apparatus of claim 1 wherein said biasing means comprises an air spring.

5. The apparatus of claim 1 further comprising an idler roller having an axis of rotation generally parallel to said cylindrical axis and being resiliently mounted to said support frame on the side of said container path opposite the side on which is mounted said rotatably driven roller, such that said idler roller resiliently engages said cap cylindrical side portion during at least a portion of the time said rotatably driven roller engages said cap.

6. The apparatus of claim 5 further comprising a second arm carrying said idler roller at a first end thereof and being mounted at the second, opposite end thereof to said support frame for pivotal movement toward and away from said container path; and a biasing means for resiliently urging said first end of said second arm toward said container path.

* * * * *